US007025112B1

(12) United States Patent
Ferrando

(10) Patent No.: US 7,025,112 B1
(45) Date of Patent: Apr. 11, 2006

(54) PRETREATMENT PROCESSING OF METAL-MATRIX CARBIDE POWER FOR MOLD CASTING OF PRODUCTS

(75) Inventor: William A. Ferrando, Arlington, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 11/011,650

(22) Filed: Dec. 15, 2004

(51) Int. Cl.
*B22D 19/00* (2006.01)

(52) U.S. Cl. ..... 164/97; 164/66.1; 164/68.1; 164/55.1

(58) Field of Classification Search ..... 164/97, 164/66.1, 68.1, 55.1, 259
See application file for complete search history.

(56) References Cited

U.S. PATENT DOCUMENTS 3,372,066 A * 3/1968 Quaas ..... 148/24
5,508,116 A * 4/1996 Barrett ..... 428/567
5,776,225 A * 7/1998 Megy ..... 75/304
6,129,134 A * 10/2000 Divecha ..... 164/97
6,129,135 A 10/2000 Divecha et al.

* cited by examiner

*Primary Examiner*—Kevin Kerns
*Assistant Examiner*—I.-H. Lin
(74) *Attorney, Agent, or Firm*—Jacob Shuster

(57) ABSTRACT

A metal-matrix material in the form of a carbide powder together with a sodium fluoride flux is deposited as a charge within a crucible for induction heating thereof to a flux melting temperature to thereby initiate pretreatment. The molten flux is spread over and covers powder particles of the metal-matrix carbide throughout, in response to stirring by rotation of an agitator during said flux melt heating within the crucible. The charge may be covered within the crucible by an air-purging blanket of argon gas during said heating. The powder fluxed charge is then cooled within the crucible before removal therefrom and sealingly packaged within aluminum soda cans or foil wrappings for future use storage. Such packaged charges are transferred from storage and introduced into a casting mold for enhanced centrifugal cast molding of metallurgical products, such as a metallic ring having an outer carbide bronze surface.

9 Claims, 2 Drawing Sheets

PRETREATMENT PROCESSING OF METAL-MATRIX CARBIDE POWER FOR MOLD CASTING OF PRODUCTS

STATEMENT OF GOVERNMENT INTEREST

The invention described herein may be manufactured and used by or for the Government of the United States of America for governmental purposes without the payment of any royalties thereon or therefore.

The present invention relates generally to enhancing mold casting of metal-matrix composites by pretreatment.

BACKGROUND OF THE INVENTION

Ingot casting of metal-matrix composites is performed by processes described in U.S. Pat. Nos. 6,129,134 and 6,129,135 to Divecha. Such casting processes are performed within a crucible having an injection feeding mechanism positioned on top thereof through which a carbide powder is ball milled and injected into a melting chamber of the crucible within which the carbide powder mixed together with argon gas is melted and transferred to a product casting mold. It is an important object of the present invention to provide for enhanced mold casting of metallic products and significantly reduce complexity and costs associated therewith.

SUMMARY OF THE INVENTION

Pursuant to the present invention, a carbide powder mixture with flux is deposited without injection into a melting chamber of an inductive heating crucible to undergo pretreatment by initial heating thereof to a flux melt temperature under a blanket of air-purging argon gas injected before undergoing flux melting and mixture stirring for powder covering flux distribution. After such heating and stirring of the powder mixture to establish its molten fluxed condition, it is ground to remove any powder clumps before cooling. The fluxed powder is then withdrawn from the crucible and sealingly packaged within aluminum soda cans or aluminum foil wrappings for future use storage. The fluxed powder packages are withdrawn from storage for introduction into casting molds for enhanced centrifugal casting of metallurgical product such as a ring having an outer carbide surface.

BRIEF DESCRIPTION OF THE DRAWING

A more complete appreciation of the invention and many of its attendant advantages will be readily appreciated as the same becomes better understood by reference to the following detailed description when considered in connection with the accompanying drawing wherein.

DETAILED DESCRIPTION OF PREFERRED EMBODIMENT

Figure 1:
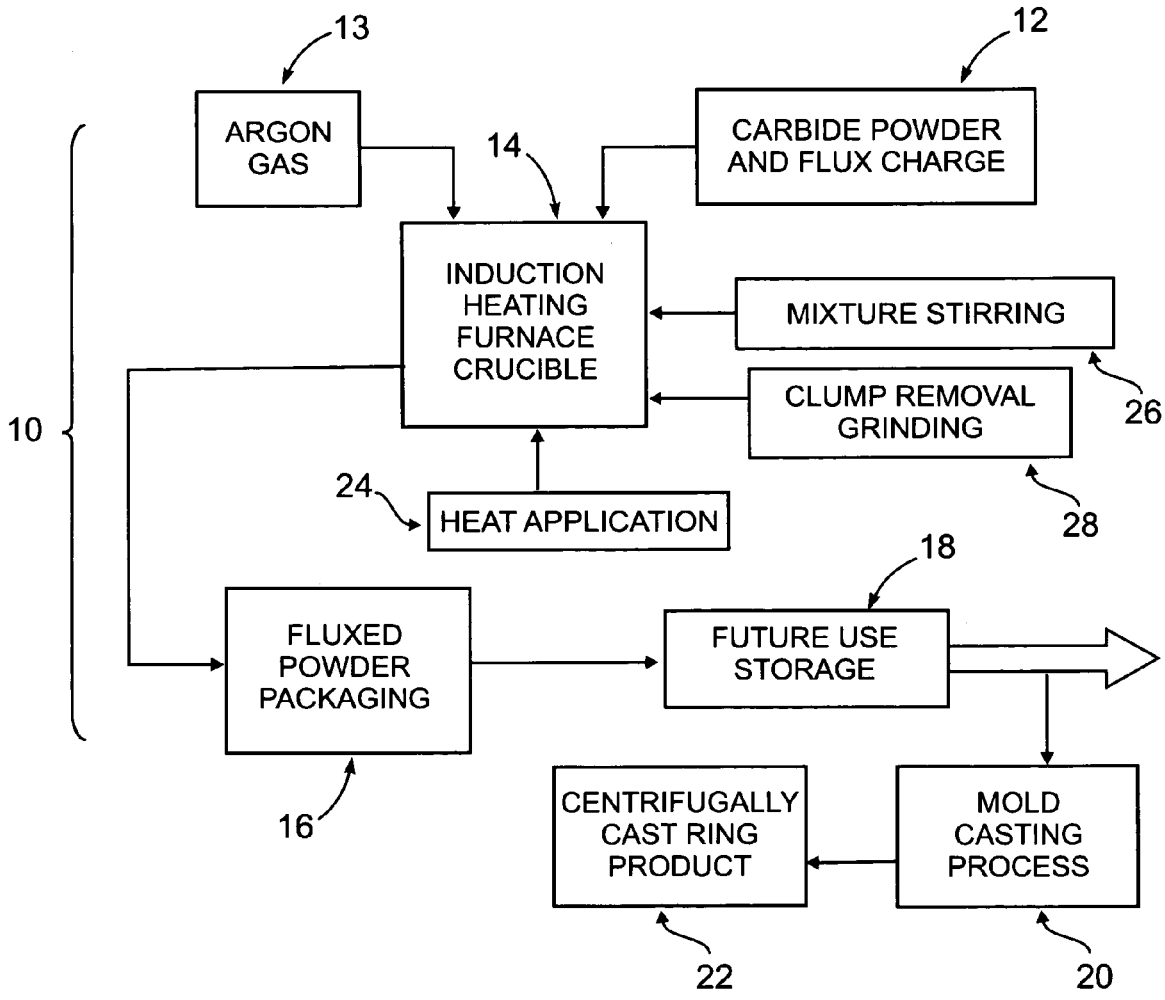
FIG. 1 is a block diagram of a processes involving metallic carbide material pretreatment pursuant to the present invention.
Figure 2:
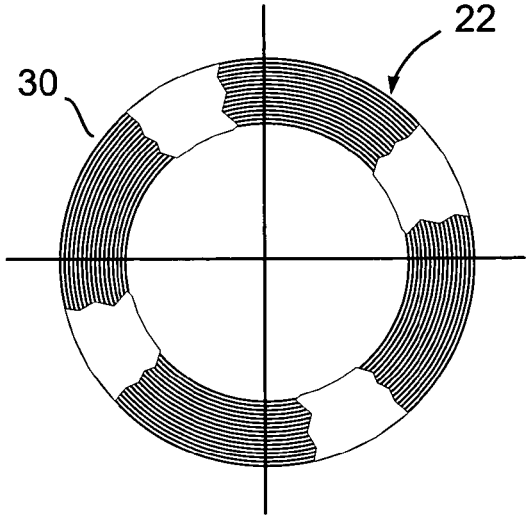
FIG. 2 is a front elevation view of a circular ring product produced by the processes diagrammed in FIG. 1.
Figure 3:
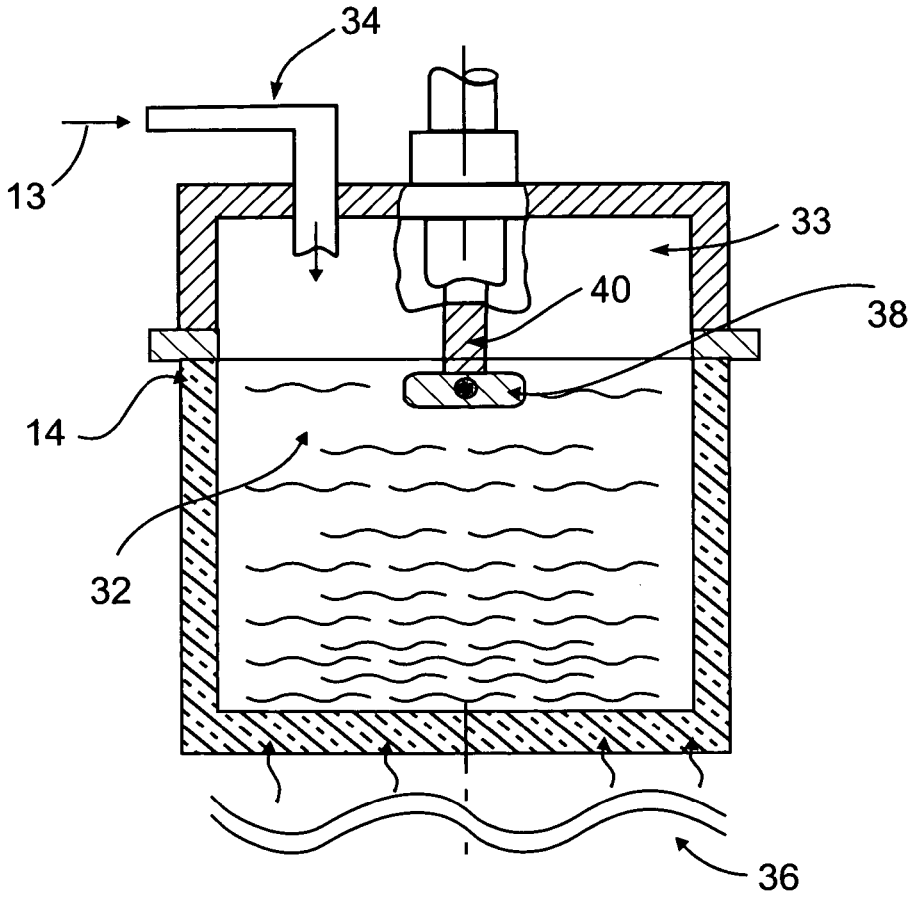
FIG. 3 is a partial cross-sectional view of the heating furnace crucible associated with the pretreatment process diagrammed in FIG. 1.

Referring now to the drawing in detail, FIG. 1 diagrams a process 10 for pretreatment of a charge 12 formed by a mixture of metal-matrix material and flux deposited together directly into an open upper end of an induction heating furnace crucible 14 as shown in FIG. 3. The pretreatment process 10 is completed when a resulting fluxed carbide powder is removed from the crucible 14 to undergo packaging 16 before transfer to future use storage 18. A packaged portion of the pretreated metal-matrix mixture from the storage 18 for future use is utilized in a mold casting process 20 to advantageously produce a centrifugally cast metallic ring product 22 as shown in FIG. 2.

With continued reference to FIG. 1, the pretreatment process 10 initiated within the crucible 14 undergoes heating by heat application 24 so as to raise the temperature therein above the flux melting point, such as 750° C. to 800° C., for a quantity of flux that is 7.5% of the content of the charge 12 which is a tungsten type of carbide powder according to one embodiment. A blanket of the air-purging argon gas 13 is applied inside of the crucible 14, as the heat is applied, to enhance the process 10. Stirring 26 of the heated mixture within the crucible 14 is then performed so as to spread the molten flux over the particles of the carbide powder charge 12. After cooling within the crucible 14, the fluxed powder charge 12 undergoes grinding 28 to some small extent for removal of powder clumps therefrom before transfer of the charge 12 from the crucible 14 to perform the packaging 16.

According to one embodiment, the packaging 16 of the fluxed powder involves placement of a 1700 gram amount thereof into a standard aluminum soda can, weighing less than 15 grams when empty. When filled, each of such soda cans is hermetically sealed by standard processing equipment before being placed in said storage 18. An appropriate number of the filled and sealed cans may be withdrawn from the storage 18 to undergo the mold casting process 20 at the proper time, with an insignificant affect on the product 22 thereby produced.

According to another embodiment of the present invention, 300 gram portions of the fluxed carbide powder charge 12 undergoes the packaging 16 by being wrapped as a packet in a piece of commercial aluminum foil, weighing about 10 grams. Such packet of the fluxed carbide powder undergoes the mold casting process 20 by being is introduced as a bronze melt under a melt temperature of approximately 50° C. for example. The melt temperature is then raised to 1250° C., during a dwell time of about 2 minutes, to complete the melt casting process 20, producing the product 22 in the form of a 4 inch diameter ring as shown in FIG. 2, having an outer continuous surface 30 of carbide bronze.

FIG. 3 illustrates in cross-section the heating furnace crucible 14, having a melting chamber 32 into which the charge 12 is introduced to undergo the pretreatment steps of the process 10 as hereinbefore described. The argon gas 13 is directly introduced into a feeder chamber 33 located above the melting chamber 32 through an inlet tube 34 on top of the crucible 14. Such infeed of the argon gas 13 occurs during the heat application 24, effected through an induction heating element 36 at the bottom of the melting chamber 32 of the crucible 14. The stirring 26 is performed by rotation of agitator blades 38 within the melting chamber 32, at its upper end, connected to the lower end of a drive shaft 40 extending through the feeder chamber 33 from some selectively controlled motor.

The pretreatment process 10 as hereinbefore described may be utilized with compatible carbides other than the tungsten aforementioned, such as titanium, with appropriate meltable fluxes associated therewith.

Obviously, other modifications and variations of the present invention may be possible in light of the foregoing teachings. It is therefore to be understood that within the scope of the appended claims the invention may be practiced otherwise than as specifically described.

What is claimed is:

1. In combination with fabrication of a metallurgical product by mold casting of metal-matrix material, a process of pretreatment for the metal-matrix material within a heating crucible to enhance said mold casting thereof, comprising the steps of: depositing as a charge a flux together with the metal-matrix material within the crucible; heating the crucible to a temperature for melting of the flux within the deposited charge to cover the metal-matrix material; cooling the charge covered by the flux melted within the crucible; and transferring the charge, covered by the flux after said cooling thereof, from the crucible into storage for future use in the mold casting of the metallurgical product in the mold casting.

2. The combination as defined in claim 1, wherein said pretreatment process further includes the steps of: covering the deposited charge within the crucible with a blanket of air-purging gas during said heating of a bottom of the crucible; and stirring the charge covered with the melted flux during said heating within the crucible at an upper end thereof to spread the melted flux in particle covering relation to the metal-matrix material throughout the charge.

3. The combination as defined in claim 2, wherein said step of transferring the flux covered charge into the storage includes: packaging thereof within a sealed enclosure.

4. The combination as defined in claim 3, wherein said metal-matrix material is a carbide powder, the flux is a sodium fluoride and the air-purging gas is argon.

5. The combination as defined in claim 4, wherein said sealed enclosure is an aluminum soda can.

6. The combination as defined in claim 4, wherein said sealed enclosure is an aluminum foil wrapping.

7. The combination as defined in claim 1, wherein said metal-matrix material is a tungsten carbide powder.

8. The combination as defined in claim 1, wherein said metal-matrix material is a titanium carbide powder.

9. In combination with fabrication of a metallurgical product by mold casting of a metal-matrix material, a process for pretreatment of the metal-matrix material to enhance said mold casting thereof, comprising the steps of: depositing a charge of the metal-matrix material in powdered form mixed with flux within a crucible; heating the crucible to a temperature for melting of the flux therein to cover the powdered metal-matrix material; cooling the charge of the powdered metal-matrix material covered by the melted flux to form a fluxed charge within the crucible; stirring the charge during said heating thereof within the crucible to distribute the melted flux over the powdered metal-matrix material in particle covering relation thereto throughout to obtain the fluxed charge; and transferring the fluxed charge after cooling thereof from the crucible into storage for future use in the mold casting of the metallurgical product.

* * * * *